United States Patent [19]

Frain, III et al.

[11] Patent Number: 4,673,604

[45] Date of Patent: Jun. 16, 1987

[54] EXTRUSION COATED CARPET BACKING AND METHOD OF MANUFACTURE

[75] Inventors: William J. Frain, III, Atlanta, Ga.; Donald R. Hazelton, Chatham, N.J.; Edgar W. Young, Summerville, S.C.

[73] Assignee: Exxon Research & Engineering Co., Florham Park, N.J.

[21] Appl. No.: 654,906

[22] Filed: Sep. 27, 1984

[51] Int. Cl.[4] ..... B32B 3/02

[52] U.S. Cl. ..... 428/95; 156/72; 428/109

[58] Field of Search ..... 156/72; 428/85, 95, 428/96, 97, 109, 284, 286

[56] References Cited

U.S. PATENT DOCUMENTS

| | | | |
|---|---|---|---|
| 3,264,167 | 8/1966 | Sands | 428/96 |
| 3,719,547 | 3/1973 | Martin et al. | 428/97 |
| 3,882,260 | 5/1975 | Tamm et al. | 428/337 |
| 4,370,189 | 1/1983 | Siedenstrang et al. | 428/494 |
| 4,508,771 | 4/1985 | Peoples et al. | 156/72 |

*Primary Examiner*—James J. Bell

*Attorney, Agent, or Firm*—R. L. Graham

[57] ABSTRACT

A carpet construction wherein a primary carpet backing is coated with an elastomeric film and face yarns are stitched into the coated primary carpet backing.

16 Claims, No Drawings

EXTRUSION COATED CARPET BACKING AND METHOD OF MANUFACTURE

This invention relates to carpet construction and method of manufacture. In one aspect, the invention relates to a tufted carpet construction having a polyolefin primary backing coated with a thin elastomeric film.

Tufted carpets are manufactured by a process wherein tufts, or bundles of carpet fibers, are stitched into a primary carpet backing (PCB) made of woven or nonwoven fabric. The woven fabric generally comprises jute, polypropylene film yarn, etc., and the nonwoven fabric comprises polypropylene web, etc. Following the tufting operation, a secondary carpet backing is secured to the PCB by suitable adhesives. The present invention is directed specifically at the PCB and its manufacture.

In tufting carpet with face yarns to form a graphic geometric pattern, it is extremely important that each tuft be precisely placed and that it remains fixed. Even the slightest distortion or migration of the tufts becomes apparent because of the resultant nonregular pattern. Distortion in the diagonal disection are particularly troublesome because small forces result in extension in that direction. This tuft stability is particularly important in tile carpet because of the necessity that the uniform geometric pattern of the tile be maintained when installed. The fine gauge tufting used in graphic pattern carpet aids the pattern stability problem. As used herein, the term "fine gauge" tufting means 1/25 to 5/32 gauge, preferably 1/25 to 5/64, using yarns 850 to 3700 denier, preferably 850 to 2200 denier.

The nonwoven backings are frequently used on very fine gauge tufting machines, such as those required in producing geometric patterns, because the isotropic nature of the nonwovens allows for excellent stitch placement resulting in smooth, regular carpet face. The stitching is carried out much in the manner of a sewing machine process. A problem associated with the needle tufting of the nonwovens, however, is that the needles penetrate the substrate leaving a hole upon withdrawal. The hole is approximately the same size as the needle and does not close, causing the base of the tufts to be loosely held in the substrate. Moreover, in the event it becomes necessary to mend a broken tuft, additional holes must be punched which further weakens the substrate. A further problem is that holes in the fabric are aligned in the direction of machine operation such that the strength of the material is reduced. Carpet strength becomes important when the carpeting must be stretched for installation. Moreover, when multi-gauge stepover machines are used, tufting is even more damaging to the nonwoven substrate.

Frequently when woven fabrics are used as primary carpet backing in fine gauge tufting because the nonuniformity of the fabric causes needle distortion during the stitching operation. This produces an irregular pattern and frequently resulting in distorted tufts and nonsmooth carpet face. Moreover, the needles tend to fracture the fabric yarns producing dimensional stability problems because the fractured yarns do not securely anchor the tufts.

As noted above, this invention relates broadly to extrusion coating of polyolefin PCB. A number of patents disclose the coating of carpet backing with various thermoplastic materials. These patents and patent applications include UK Patent Application No. 2067576, U.S. Pat. Nos. 3,882,260, 4,370,189, 3,264,167, and Great Britain Patent Specification Nos. 113271 and 150006. These patents, however, employ the extrusion coating after the tufting operation has been completed and functions primarily to anchor the tufts in place.

SUMMARY OF THE PRESENT INVENTION

The carpet structure of the present invention comprises a polyolefin carpet backing (preferably polypropylene) coated with an elastomer containing film which in a preferred embodiment comprises a blend of (a) an olefinic elastomer, (b) an ethylene copolymer, and (c) a propylene polymer; and having a plurality of tufts stitched into the primary carpet backing.

The process comprises extruding onto a polyolefin fabric (woven or nonwoven) a hot melt of the elastomeric material forming a primary carpet backing coated with a film of an elastomeric material and thereafter stitching the primary carpet backing with face yarn to provide a tufted carpet. The coating may be on either side or both sides of the PCB. Preferably, the tufting will be at a fine gauge, in the order of 210 to 36 stitches per square inch and a yarn denier of 850 to 3700 denier, preferably 210 to 48 stitches per square inch and a yarn denier of 850 to 2200.

DESCRIPTION OF THE PREFERRED EMBODIMENTS

The present invention may be used with conventional fabric used as primary carpet backing (PCB). These include woven polypropylene, polyester and nonwoven polypropylene backings. Briefly, the PCB is constructed providing the fabric with a thin elastomeric film prior to the tufting operations. The elastomeric film provides several important functions including the following: (1) excellent stitch placement and stitch lock, (2) very little face yarn distortion, (3) improves the strength of the PCB, (4) the PCB mends without further weakening of the substrate, (5) the PCB offers excellent isotropic characteristics, and (6) the PCB eliminates edge fraying and raveling and back pulling.

These advantages are particularly important in the manufacture by fine gauge tufting of graphic geometric designs where very little tuft distortion can be tolerated. When used to coat a woven fabric, the elastomeric film secures the warp yarns and fill yarns together such that when the needles penetrate the coated fabric, there is no needle or yarn lateral movement which would cause tuft distortion. The elastomeric film further prevents or at least inhibits any yarn fracture resulting from needle penetration. When used to coat both woven or nonwoven fabric, the elastomeric nature of the film anchors the tufts at their base further stabilizing the carpet.

The film with elastomericl properties imparts an isotropic characteristic to the primary carpet backing, which is particularly important in woven fabric. Thus, when the final carpet is stretched in any direction, the distortion of face yarns defining the pattern is not magnified in any particular direction.

The PCB which may be coated with the elastomeric film according to the present invention includes conventional PP woven and nonwoven fabrics. The woven fabrics typically include weaves having (picks per inch), 20 to 28 warp ends per inch and from 8 to 22 weft yarns per lineal inch. The weave may comprise monofilament yarns and tapes and slit film tape having deniers ranging from 350 to 1300.

Although a wide variety of resin blends may be used to extrusion coat the primary carpet backing fabric, the preferred material is a polyolefin containing a small amount of elastomeric material. The coating composition, thus, may be made from a blend of a polyolefin (such as ethylene and propylene polymers and copolymers) and an elastomer (such as EPR, EPDM or PIB). When using a polypropylene PCB fabric, the polyolefin, for compatibility, should be predominantly polypropylene with small amounts of elastomer. An ethylene copolymer to enhance adhesion and processability for coextrusion should also be present.

The concentration of the elastomer should be sufficient to impart the properties of tuft lock and PCB stability as discussed above. Elastomer concentrations of from 1 to 20 wt. % in the blend of elastomer and polyolefin are satisfactory. For best results the coating should comprise three components blended at the following concentration (based on blend weight):

| | Concentration | Preferred Concentration |
|---|---|---|
| Component A: olefinic elastomer | 1–20 wt. % | 3–10 wt. % |
| Component B: ethylene copolymer | 4–30 wt. % | 5–15 wt. % |
| Component C: propylene polymer | 50–95 wt. % | 75–92 wt. % |

Component A:

The olefinic elastomer component of the composition may comprise an ethylene copolymer elastomer, such as a copolymer of ethylene with higher alpha-olefin. Preferred ethylene elastomer copolymers include EPR (ASTM D-1418-72a designation of EPM for an ethylene-propylene elastomer copolymer), or EPDM (ASTM D-1418-72a designation for an ethylene-propylene diene elastomer terpolymer). Also usable are polyisobutylene rubbers, butyl rubbers and halogenated butyl rubbers.

Preferred ethylene elastomer copolymers for use herein comprise from 30 to 90 weight percent ethylene, more preferably from 35 to 80 weight percent ethylene, and most preferably from 50 to 80 weight percent ethylene. In some cases an oil extended elastomer can be employed in the compositions of this invention.

EPDM is a terpolymer of ethylene, a higher alpha-olefin such as propylene, and a nonconjugated diene. In such elastomers the nonconjugated diolefin may be straight chain, branched chain or cyclic hydrocarbon diolefins having from 6 to 15 carbon atoms.

Of the nonconjugated dienes typically used to prepare these copolymers, preferred are dicyclopentadiene, 1,4-hexadiene, 5-methylene-2-norbornene and 5-ethylidene-2-norbornene; 5-ethylidene-2-norbornene (ENB) and 1,4-hexadiene are particularly preferred diolefins. EDPM elastomers in their method of manufacture are well nown to those skilled in the art. Oil extended EPDM elastomers may also be used. Preferred EPDM elastomers contain from 30 to 90 weight percent ethylene and most preferably from 50 to 80 weight percent ethylene, and from 0.5 to 15 weight percent of the nonconjugated diolefin.

The olefinic elastomer useful in this invention can also be a polyisobutylene, a copolymer of isobutylene and isoprene (generally known as butyl rubber) or a halogenated copolymer of isobutylene and isoprene (generally known as halogenated butyl rubber, such as chlorinated, brominated and chlorobrominated butyl rubber). Butyl rubber is a vulcanizable rubber copolymer containing from 85 to 99.5 percent combined isoolefin having from 4 to 8 carbon atoms and from 0.5 to 15 percent combined conjugated diolefin having from 4 to 8 carbon atoms. Such copolymers and their preparation are well known, and generally the isoolefin is a compound such as isobutylene and the diolefin is a compound such as butadiene or isoprene. Halogenated butyl rubbers are also well known; chlorinated and brominated butyl rubber generally contain at least 0.5 weight percent combined halogen and up to 1 atom of halogen per double bond in the copolymer; chlorobrominated butyl rubber generally contains from 1.0 to 3.0 weight percent bromine and from 0.05 to 0.5 weight percent chlorine.

Component B:

The ethylene copolymers include those of ethylene and alpha-olefins having 3 to 16 carbon atoms such as propylene or 1-butene. Also included are copolymers of ethylene with unsaturated esters of a lower carboxylic acid or with an unsaturated carboxylic acid. In particular, copolymers of ethylene with vinyl acetate (EVA), or with acrylic acid (EAA), or methacrylic acid, or with acrylates such as methylacrylate and ethylacrylate may be employed. The polyethylene copolymers to be employed generally contain from 50 to 99 weight percent ethylene, most preferably from 60 to 95 weight percent ethylene. EVA containing from 5 to 40 weight percent vinyl acetate and EAA containing 5–40 weight percent of acrylic acid are particularly preferred.

A preferred melt index (ASTM D-1238, Condition E) for component B is from 1 to 20, more preferably from 2 to 10.

Component C:

The propylene polymer component of the composition may be polypropylene homopolymer such as that used in the manufacture of primary carpet backing. These homopolymers are highly crystalline isotactic or syndiotactic. The polypropylene component also may be a copolymer, referred to as polypropylene reactor copolymer, either random or block copolymer, containing minor amounts of alpha-olefin comonomer of 2 to 16 carbon atoms.

Other Additives:

The composition may also include an extender hydrocarbon oil such as that disclosed in U.S. Pat. No. 4,303,571 which functions as a processing aid. Oils sold under the trademarks "Flexon" and "Sunpar" are suitable processing aids for purposes of the present invention. The composition may also include fillers such as calcium carbonate and other conventional additives, such as processing aids, and stabilizers.

Preparation of compositions usable in this invention can be achieved in several different ways. The various components may be brought into intimate contact by, for example, dry blending these materials and then passing the overall composition through a compounding extruder. Alternatively, the components may be fed directly to a mixing device such as a compounding extruder, high shear continuous mixer, two roll mill or an internal mixer such as a Banbury mixer. The optional ingredients previously described can be added to the composition during this mixing operation. It is also possible to achieve melt mixing in an extruder section of an extrusion coating apparatus. Overall, the objective is to obtain a uniform dispersion of all ingredients and this is readily achieved by inducing sufficient shear and heat to cause the plastics component(s) to melt. However, time and temperature of mixing should be controlled as is normally done by one skilled in the art so as to avoid molecular weight degradation.

As mentioned earlier, the elastomeric film is applied to the PCB fabric by extrusion coating. As used herein the term "extrusion coating" means a coating process in which a molten thermoplastic composition as defined hereinbefore is extruded onto a PCB substrate.

The extrusion coating of the PCB fabric may be carried out on conventional extrusion coating equipment, which are commercially available. It has been found that at typical commercial coating line speeds as demonstrated by the examples presented herein, the elastomeric composition may be readily extruded onto PCB substrates. The tufting operation may also be carried out on conventional tufting equipment, one of which is described in the Examples.

The elastomeric blend may be extruded onto the PCB fabric to form a thin film of from 0.5 to 10 mils, with thicknesses between 1 and 5 mils being preferred.

The coated fabric is then tufted to place face yarns in the desired pattern. The coated film may be on either or both sides. Conventional tufting equipment may be used at stitch spacing of from 25 to 6.5 stitches per inch. Moreover, any face yarn may be used including conventional nylon, polyester, acrylic, rayon yarns having deniers ranging from 850 to 3700.

The following examples demonstrate the superiority of the PCB constructed according to the present invention over PCB of prior art construction:

Extrusion Coating Equipment:

Extruder six-inch diameter Egan-extruder discharging into 150-inch slot die at 575° F.

Extrusion Coating Material:

| Concentrate | | Wt. % |
|---|---|---|
| Ethylene Copolymer | EVA[1] | 36.1 |
| | EVA[2] | 11.9 |
| Elastomer | EPR[3] | 28.8 |
| Other | $CaCO_3$ | 3.0 |
| | Extender Oil[4] | 20.0 |
| | Miscellaneous | 0.25[5] |

Resin

Crystalline polypropylene[6]

Primary Carpet Backing Fabrics (Substrate)

Woven polypropylene 24 × 11, 24 × 13 (warp ends per inch × weft ends per inch)

Warp yarns 500 denier (approx.)

-continued

Fill yarns 1000 denier (approx.)

Fabric width - 152 inches

[1]EVA contains 18 wt % VA and has a melt index of 2.5 dg/min at 190C

[2]EVA contains 40 wt % VA and has a melt index of 70 dg/min at 190C

[3]EPR contains 35 wt % propylene comonomer and a Mooney viscosity ML(1 + 8) @ 260° F. of 50 sold as Vistanex 3708 by Exxon Chemical Company

[4]paraffinic hydrocarbon oil sold as Sunpar 2280 by Exxon Chemical Company

[5]included 0.25 wt % Irganox 1010, a heat stabilizer (hindered phenol)

[6]manufactured by Eastman and sold as Tenite Polypropylene P7673-625P (70 MFR, 0.902 density)

Extrusion Coating Procedure

The concentrate was let down with the PP resin directly in the extruder in a ratio of 1:5 to form the coating material blend.

A 150-inch film of the elastomeric coating material was extruded onto the 152-inch wide woven polypropylene of each of the two PCB substrates (24×11, and 24×13). The elastomeric film was coated at speeds of 170 fpm and at a thickness of 1–2 mils. Also, the 24×13 fabric was coated with PP only for comparative testing.

Tufting Procedure

Samples 30-inches wide and 5 yards long of the coated fabric were cut and tufted with a graphic pattern using multigauge stepover tufting. The samples with coating down were tufted at 8 stitches per inch and 12 stitches per inch with 1800 and 2200 denier nylon face yarn.

Test Procedure of Coated Carpet Backing Using Instron Instrument

Tensile Strength: ASTM No. D-1682

Elongation: ASTM No. D-1682

Burst: ASTM No. D-3786

Puncture: ASTM No. D-3787

Peel: ASTM No. D-903

Test Procedure of Tufted Coated Carpet Using Instron Instrument

Tensile Strength: ASTM No. D-1335

Elongation: ASTM No. D-1335

10% Extension: ASTM No. D-1682T

Table I presents the data for the woven PCB (before tufting) without coating and with coating.

TABLE I

Extrusion Coated PCB

| PCB | Lbs. Tensile Warp | Lbs. Tensile Weft | % Elongation Warp | % Elongation Weft | Weight oz/yd² | Burst lbs | Puncture lbs | Peel Lbs. Warp | Peel Lbs. Weft | Film Thickness (1) mils | Film Thickness (2) mils |
|---|---|---|---|---|---|---|---|---|---|---|---|
| 24 × 11 | 158 | 110 | | | 3.21 | | | | | | |
| 24 × 13 | 152 | 128 | | | 3.49 | | | | | | |
| 24 × 13 (coated with PP only) | 156 | 151 | 26.3 | 22.8 | 4.86 | 319 | 38 | 0.5 | 0.15 | 1.9 | 2.0 |
| 24 × 13 (coated with elastomeric film) | 178 | 160 | 26.0 | 27.4 | 5.44 | 302 | 51 | 1.0 | 0.88 | 3.5 | 2.9 |
| 24 × 11 (coated with elastomeric film) | 164 | 146 | 24.6 | 29.5 | 3.93 | 269 | 48 | unable to peel (film too thin) | | | 1.1 |

(1) Measured (2) Calculated

As can be seen by Table I, the extrusion coating increased the tensile strength of the PCB in both the weft and fill directions. Moreover, the elastomeric coating quality increased the puncture strength to peel strength, and the percent elongation of the PCB as compared to PCB coated with PP.

Table II presents the data on tufted carpet having an elastomeric coating coextruded thereon.

TABLE II

| Stitch | PCB | Coating | Tensile - lbs | | | Elongation % | | | 10% Extension lbs | | |
|---|---|---|---|---|---|---|---|---|---|---|---|
| | | | Warp | Weft | Bias | Warp | Weft | Bias | Warp | Weft | Bias |
| 8SPI | Control | | 115 | 82 | 201 | 18.0 | 15.7 | 64.8 | 64.0 | 55.7 | 1.6 |
| 8SPI | 24 × 11 | elas. film | 126 | 53 | 137 | 26.7 | 16.7 | 61.0 | 45.6 | 36.4 | 4.9 |
| 8SPI | 24 × 13 | elas. film | 137 | 73 | 189 | 31.7 | 19.2 | 65.5 | 30.1 | 41.4 | 5.8 |
| 12SPI | 24 × 13 | elas. film | 109 | 75 | 182 | 30.2 | 21.5 | 68.9 | 18.4 | 35.1 | 6.0 |
| 12SPI | 24 × 13 | PP only | 123 | 69 | 176 | 32.5 | 20.4 | 62.2 | 22.4 | 27.4 | 6.5 |

The control sample was a 24×15 PP woven (496 warp denier and 1187 fill denier) PCB which had been needle punched prior to tufting. This PCB is of the type that is generally used in manufacturing of graphic fabrics. The high picks per inch (15) in the fill enhances graphic pattern stability.

The data clearly show the improvements in PCB constructed according to the present invention in distortion stability over the control PCB in the bias direction (i.e., diagonal—in a direction intermediate between machine direction and transverse direction). As can be seen with reference to the control PCB, very small forces (1.6 pounds) are required to impart 10% bias extension which results in pattern distortion. Extension of this magnitude cannot be tolerated in many graphic geometric patterns. The PCB constructed according to the present invention increased the resistance to extension in the bias direction by more than three times compared to the control PCB. This is particularly surprising when realizing the control employed more weft yarns [15 (1187 denier) vs. 11 or 13 (997 denier)]. The warp yarns of the control were about the same denier as those of the extrusion coated sample. The higher values of the control PCB for 10% distortion in the warp and fill directions reflect the larger amounts of PP in those directions.

Needlepunch Tests

Samples of the three fabrics coated in the experiments were needlepunched using a commercial needle punching apparatus. Based on observations during the needlepunching tests, needle penetration was much better with the elastomeric coated samples than the PP coated sample. The brittle PP appeared to cause excessive equipment vibration and needle deflection during the tests.

Photomicrographs were taken of each sample following the needlepunching tests. The fabric coated with PP were observed to have brittle fracturing and tear propagation in both the coating and the yarns. The elastomeric coated fabric, however, exhibited very little fracturing. More importantly, however, the elastomeric characteristic of the coating caused the material to recover following needle withdrawal. This is important because this recovery anchors the tufts in place during the tufting operation resulting in an even, regular face yarn pattern.

In summary, the present invention offers several advantages over the prior art in the manufacture of the PCB (less needle distortion), in the installation (less bias distortion), and in the stability of the PCB (full yarns anchored in place).

What is claimed is:

1. A carpet construction comprising (a) a polyolefin primary carpet backing fabric having a thin elastomer containing film coextruded to at least one side thereof, and (b) face yarns stitched into said primary carpet backing fabric wherein said elastomer containing film comprises an elastomer and a polyolefin.

2. The carpet construction of claim 1 wherein the carpet backing is woven fabric and wherein the face yarn having a denier between 850 and 2200 is stitched into said carpet backing in a pattern of at least 48 stitches per square inch.

3. The carpet construction of claim 1 wherein the primary carpet backing is woven PP, and wherein the film comprises a blend of from 1 to 20 wt % of polyolefin elastomer and from 80 to 99 wt % of a polyolefin.

4. The carpet construction of claim 1 wherein the film comprises a blend of (a) from 1 to 20 wt % of an olefinic elastomer,
(b) from 4 to 30 wt % of an ethylene copolymer, and
(c) from 50 to 95 wt % of a propylene polymer.

5. The carpet construction of claim 4 wherein the blend further includes an extender hydrocarbon oil.

6. The carpet construction of claim 4 wherein the copolymer is an EVA or an EAA.

7. The carpet construction of claim 1 wherein the primary carpet backing is a nonwoven scrim.

8. The carpet construction of claim 4 wherein the film is less than 5 mils thick.

9. The carpet construction of claim 8 wherein the film is adhered by hot melt coextrusion.

10. The carpet construction of claim 9 wherein the elastomer is an olefinic elastomer.

11. The carpet construction of claim 10 wherein the elastomer is EPR or EPDM.

12. A method of manufacturing a carpet construction which comprises:

(a) extrusion coating onto a polyolefin primary carpet backing fabric a thin film comprising a hot melt blend of a major amount of a polyolefin and a minor amount of an olefinic elastomer; and
(b) thereafter stitching into said coated carpet backing face yarns.

13. The method of claim 12 wherein the film comprises a blend of (a) from 1 to 20 wt % of an olefinic elastomer,
(b) from 4 to 30 wt % of an ethylene copolymer, and
(c) from 50 to 95 wt % of a propylene polymer
(d) from 1 to 10 wt % of an extender hydrocarbon oil.

14. The method of claim 13 wherein the film is less than 5 mils thick.

15. The method of claim 13 wherein the carpet backing fabric is woven yarns having a denier between 350 and 1300 and the face yarn has a denier between 850 and 2200 and is stitched into said carpet backing at a stitch pattern of at least 48 stitches per square inch.

16. The method of claim 15 wherein the face yarn is nylon, polyester, acrylic, or rayon arranged to form a geometric pattern on the carpet fabric.

* * * * *